United States Patent [19]

Couillard

[11] Patent Number: 4,643,651

[45] Date of Patent: Feb. 17, 1987

[54] CONSTANT FLOW RATE LIQUID PUMPING SYSTEM

[75] Inventor: Francois Couillard, Pau, France

[73] Assignee: Groupe Industriel de Realisation et d'Application Gira S.A., Morlaas, France

[21] Appl. No.: 771,843

[22] Filed: Sep. 3, 1985

Related U.S. Application Data

[63] Continuation-in-part of Ser. No. 645,611, Aug. 29, 1984, abandoned.

[30] Foreign Application Priority Data

Aug. 31, 1983 [FR] France ..... 83 13995

[51] Int. Cl.[4] ..... F04B 11/00; F04B 9/04

[52] U.S. Cl. ..... 417/265; 417/266; 417/267

[58] Field of Search ..... 417/256, 257, 265, 266, 417/267

[56] References Cited

U.S. PATENT DOCUMENTS

| | | | |
|---|---|---|---|
| Re. 7,302 | 9/1876 | Lonut | 417/266 |
| 370,376 | 9/1887 | Chichester | 417/265 |
| 1,889,640 | 11/1932 | Cowtois | 417/266 X |
| 3,597,114 | 8/1971 | Hrdina | 417/265 |
| 3,601,505 | 8/1971 | Bratsch | 417/266 |
| 3,809,507 | 5/1974 | Baglai | 417/259 X |

FOREIGN PATENT DOCUMENTS

| | | | |
|---|---|---|---|
| 106875 | 1/1925 | Switzerland | 417/266 |
| 451110 | 7/1936 | United Kingdom | 417/266 |
| 900607 | 7/1962 | United Kingdom | 417/265 |
| 1534650 | 12/1978 | United Kingdom | 417/265 |

*Primary Examiner*—Carlton R. Croyle
*Assistant Examiner*—Theodore Olds
*Attorney, Agent, or Firm*—Burgess, Ryan & Wayne

[57] ABSTRACT

The present invention is a liquid pumping system with constant flow rate. The system contains at least one first cylinder means and reciprocating piston means defining a first pumping capacity ($V_1$), at least one second pumping unit including cylinder means and reciprocating piston means defining a second pumping capacity ($V_2$) and at least one complimentary pumping unit including cylinder means and reciprocating piston means defining a complimentary pumping capacity ($V_0$) the driving means for actuating the piston means synchronously but in phase opposition between the piston means of the first unit and the second and complimentary pumping units in such a manner that each piston performs alternating suction and discharge strokes linearly having feed lines and check valves wherein $V_1$ equals $V_2$ plus $V_0$.

3 Claims, 2 Drawing Figures

CONSTANT FLOW RATE LIQUID PUMPING SYSTEM

This application is a continuation-in-part of U.S. Ser. No. 645,611 filed Aug. 29, 1984 now abandoned.

FIELD OF THE INVENTION

The present invention relates to a pumping system adapted to provide an accurate constant liquid flow rate of a predetermined value, which is required in many technical applications and especially in the field of liquid phase chromatography, where precision and consistency of the chromatographic analysis results can only be warranted when a perfectly constant flow rate of a predetermined value of the liquid to be analyzed is ensured.

BACKGROUND OF THE INVENTION

According to one basic solution of the above problem it has been proposed in the prior art to connect to the liquid inlet of the chromatograph proper a feeding line provided with check-valves and associated to two single-acting cylinder and piston pumping units connected to the feeding line respectively at a first connecting point and a second connecting point located downstream from said first connecting point, with reference to the direction of the flow of liquid to be analyzed. The above-mentioned check-valves interposed in the feeding line, as well as the driving and/or control means of said pumping units, are arranged in such a manner that when one of said pumping units performs its suction stroke, drawing liquid from the feeding line into the cylinder of said unit, the said pumping unit is only connected by the feeding line to the liquid source, but is disconnected from the chromatograph, whereas at the same time the other pumping unit, performing its discharge stroke, is connected to the chromatograph and disconnected from the liquid source, so as to provide the required liquid flow toward the chromatograph while the first-mentioned pumping unit is in the process of taking in liquid by suction.

It should be noted that for obvious technical reasons it is desirable that the intake or suction stroke of every pumping unit be performed as rapidly as possible or, in other words, take up the smallest possible fraction of the total time required for performing the complete pumping cycle constituted by the suction stroke and the discharge stroke.

Supposing that in a given installation of the type considered herein-before the first pumping unit (or upstream unit), which is connected to the first connecting point, has a capacity $V_1$ of 300 $cm^3$, its suction stroke time $t^A{}_1$ being 10 seconds and its discharge stroke time $t_{R1}$ being 30 seconds, while the second pumping unit (or downstream unit), which is connected to the second connecting point, has to take in, during the discharge stroke of the first unit, a predetermined proportion of the 300 $cm^3$ discharged from the first unit, which portion of liquid will subsequently be discharged by said second (or downstream) unit during the suction stroke of the first unit, so as to maintain the flow rate of the liquid delivered to the chromatograph at a constant value.

On the base of these data, the first pumping unit will provide an output of liquid during its discharge stroke which equals $$(V_1/t_{R1})=(300\ cm^3/30\ s)$$

With a view to feeding the chromatograph at a constant flow rate, as required, the second pumping unit must then have a capacity of 75 $cm^3$, its discharge stroke time must be 10 seconds and its suction stroke time 30 seconds. Under these conditions, the second unit will take in 75 $cm^3$ from the 300 $cm^3$ output of the first unit, leaving 225 $cm^3$ to be delivered to the chromatograph during the 30 seconds of the discharge stroke time of said first unit, and will deliver said 75 $cm^3$ to the chromatograph during the 10 seconds of the suction stroke time of the first unit.

In other words, the chromatograph will be fed with a constant flow rate of 75 $cm^3$ per 10 seconds, provided, of course, that the pistons of the pumping units are driven in accordance with a linear characteristic. Obviously, if the respective stroke lengths of the two pistons are equal, their cross-sectional areas must be proportional to the respective output quantities of the units (in the present example, proportional to 300/75). The pistons will be actuated in a mutually reversed manner, i.e. one unit performing its intake stroke while the other performs its output stroke, which is easily achieved by well known common driving means, such as a shaft provided with conveniently shaped and positioned actuating cams.

The above conditions can be expressed by the general equation:

$$(V_2/V_1)=t_{A1}/(t_{A1}+t_{R1})$$

wherein:

$V_1$=capacity of the first (upstream) pumping unit;

$V_2$=capacity of the second (downstream) pumping unit;

$t_{A1}$=suction stroke time of the first pumping unit;

$t_{R1}$=discharge stroke time of the first pumping unit.

Indeed, the ratio of the complete duration of the operating cycle (suction plus discharge) of the first pumping unit (upstream unit) to the duration of its suction stroke obviously must be equal to the ratio of the capacity of said first (upstream) unit to the capacity of the second (downstream) unit with a view to allowing said second unit to feed on the output of the first unit, during the discharge stroke of the latter, with an amount of liquid sufficient to subsequently feed the chromatograph at a constant flow rate during the suction stroke of the first unit.

Such known arrangement thus theoretically allows a constant rate of flow towards the chromatograph to be achieved. However, in practice, it has been observed that the suction effect due to the operation of the first unit in the feeding line upstream from the first (or upstream) connecting point being interrupted during the suction stroke of the second unit (which takes in liquid not directly provided by the upstream portion of the feeding line, but by the liquid output provided by the first unit during the discharge stroke thereof), that consequently there is a considerable hazard of generating undesirable phenomena such as cavitation and the like, which would substantially impair the imperatively required constant flow rate of the liquid delivered to the chromatograph. Such risk increases as the flow rate of liquid delivered to the chromatograph is increased. It also increases with the frequency of the strokes of the pumping unit cylinders.

The present invention is aimed in particular at overcoming this drawback of the conventional systems comprising two pumping units.

It is thus one main object of the invention to provide a pumping system which ensures achievement of a strictly constant feeding flow rate of a chromatograph or the like, whichever may be the absolute respective values of the required flow rate and the respective values of the suction and discharge stroke times of the pistons in the pumping units.

SUMMARY DESCRIPTION OF THE INVENTION

With these aims and objects in view it has been found that the above-mentioned drawbacks of the prior installations can be overcome in a surprisingly simple manner by providing, in addition to the two pumping units used up to now, at least one third or complementary pumping unit of the same (i.e. piston and cylinder) type which is connected to the feed line at a complementary connecting point upstream from the above-mentioned first connecting point, and possibly a complementary check-valve in the feed line located upstream from the above-mentioned first connecting point, said complementary pumping unit being driven synchronously and in phase with the above-mentioned second (downstream) pumping unit and synchronously and in phase opposition with the above-mentioned first (upstream) pumping unit and having a capacity $V_0$ so selected as to comply with the relation:

$$(V_0/t_{R1})=V_1/(t_{A1}+t_{R1})=(V_2/t_{A1})$$

wherein the symbols other than $V_0$ have the same signification as indicated herein-before.

Indeed, when these conditions are complied with, it will be found that the respective flow rates at any point of the feed line upstream from the complementary connecting point, on the one hand, and at the inlet of the chromatograph, on the other hand, are substantially constant, thus eliminating, or at least considerably reducing the risks of cavitation or similar undesirable phenomena.

If follows from the above relation that $$V_1=V_0+V_2$$

$$V_0=V_1-V_2$$

Each one of said first, second and complementary pumping units may be replaced by an assembly comprising two or more pumping sub-units, provided that the three assemblies comply with the conditions set forth herein-above, $V_1$, $V_2$ and $V_0$ then corresponding respectively to the sum of the capacities of the related sub-units replacing respectively the first and/or second and/or complementary pumping unit.

Still under the above-defined conditions, when the pistons of the three pumping units have equal stroke lengths, the cross-sectional areas of the cylinders of said units will correspond to the relation:

$$(S_0/t_{R1})=S_1/(t_{A1}+t_{R1})=(S_2/t_{A1})$$

wherein $S_0$, $S_1$ and $S_2$ represent the cross-sectional area of the cylinder of the complementary, the first and the second pumping units, respectively.

The diameters $D_0$, $D_1$ and $D_2$ of the respective cylinders of the complementary, first and second pumping units will then, of course, comply with the expression:

$$\frac{D_0}{\sqrt{t_{R1}}}=\frac{D_1}{\sqrt{t_{A1}+t_{R1}}}=\frac{D_2}{\sqrt{t_{A1}}}$$

As already mentioned herein-before, all the preceding considerations apply to an installation wherein the pistons of the pumping units are actuated so as to be displaced in accordance with linear characteristics, i.e., broadly speaking, at constant speed during each stroke, especially during the discharge stroke.

According to another embodiment of the invention the above-mentioned three pumping units are replaced by one single pumping unit comprising a cylinder having two bore sections of different respective diameters and one single piston having two sections of different respective diameters corresponding to those of said bore sections, said bore and piston sections being coaxial to each other, and the smaller diameter piston section being guided in the smaller diameter bore section, while the larger diameter section of the piston is guided in the larger diameter bore section of said cylinder, thus providing, in front of the two end faces of the piston, chambers which correspond to the chambers defined in the above-mentioned first and second pumping units, and an annular chamber delimited by the annular piston face opposite to the large diameter end face thereof, on the one hand, and a radial annular wall portion of the cylinder connecting said larger and smaller diameter bore portions, on the other hand, said annular chamber corresponding to the chamber defined in the above-mentioned complementary pumping unit. The respective capacities of such chambers are so selected as to correspond to those of the three pumping units, as explained herein-before, said chambers being connected to the feed line in a manner similar to that described with reference to the above first embodiment, and the piston being actuated in such a manner that its strokes are effected in accordance with linear characteristics (i.e. at constant speed). It will be understood that—in a manner similar to that described with references to the preceding embodiment—when the piston is displaced in one direction, it will discharge the chamber delimited by its smaller diameter end face and the annular chamber, while loading the chamber delimited by its larger diameter end face, whereas, when being displaced in the opposite direction, said piston will discharge this latter chamber while loading the two first-mentioned ones.

These and other features, objects and advantages of the invention will become more clearly apparent from the following description of preferred embodiments thereof with reference to the appended drawing, which is given by way of illustration, but not of limitation.

DETAILED DESCRIPTION OF PREFERRED EMBODIMENTS

Figure 1:
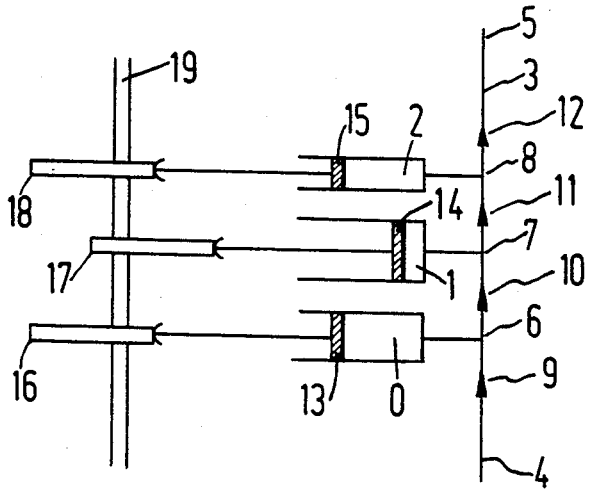
FIG. 1 shows schematically a first embodiment of the present invention.

The pumping system shown in FIG. 1 comprises a feed line 3 connected at an upstream point 4 to a source S of liquid to be delivered at a constant flow rate, for example, to a chromatograph C at a downstream point 5. At three spaced points located between points 4 and 5 T-joints or couplings are interposed in feed line 3. The first one of said couplings, designated by reference numeral 7, connects feed line 3 to a first pumping unit comprising a cylinder 1 and a piston 14 movably mounted therein. The second coupling 8, located downstream from coupling 7 (with reference to the direction of flow through the feed line) connects said feed line to a second pumping unit comprising a cylinder 2 and a piston 15 movably mounted therein. The third coupling 6, located upstream from coupling 7, connects feed line 3 to a complementary pumping unit comprising a cylinder 0 and a piston 13 movably mounted therein.

A check valve 9 allowing liquid to flow in the feeding direction, i.e. from point 4 to point 5 of feeding line 3, but preventing the liquid from flowing in the opposite direction, is provided on feed line 3 at a point located between upstream point 4 and coupling 6. Another similarly arranged check valve 10 performing the same function as check valve 9 is provided in feed line 3 at a point located between couplings 6 and 7. Still another check valve 11 arranged and operating in a manner similar to that of the preceding two check valves is provided in feed line 3 at a location between coupling 7 and coupling 8, and yet another check-valve 12 of the same kind and operating mode is arranged downstream from coupling 8, i.e. between coupling 8 and downstream point 5 of the feed line. It is obvious from the foregoing description that each one of check valves 9, 10, 11, 12 will allow liquid to be drawn in from upstream point 4 by any one of pumping units 1, 14 and 2, 15 and 0, 13, while preventing liquid discharged by any one of said units from flowing toward the source, i.e. toward upstream point 4, any liquid discharged by any one of the three pumping units being thus forced to flow toward downstream point 5 (i.e. toward the chromatograph or the like).

A device for driving pistons 13, 14, 15 in synchronism, but in phase opposition as explained herein-below, comprises a driving shaft 19 provided with cams 16, 17, 18 which are associated through corresponding cam followers in a manner known per se to piston 13, 14 and 15, respectively. Said cams are shaped, according to well-known methods, so as to actuate the associated pistons in accordance with a linear motion characteristic, i.e. so that each stroke of each piston is performed at a constant speed. The constant speed of the intake stroke of any piston may be, of course—and, in fact, is in the present case—different from the constant speed of the output or discharge stroke of said piston, as already mentioned in the introduction herein-above. Furthermore, cams 16, 17, 18 are so arranged that cams 16 and 18 drive pistons 13 and 15, respectively, in phase opposition with respect to cam 17 actuating piston 14. In other words, while piston 14 performs its discharge stroke, pistons 13 and 15 perform their intake or suction stroke, in such a manner that the instant at which piston 14 reaches any one of its two stroke end positions coincides exactly with the instant at which pistons 13 and 15 reach their opposite stroke end position.

In operation, during the discharge stroke of first pumping unit 1, 14 (which may be considered as being the main unit) liquid is fed therefrom toward downstream point 5 and second pumping unit 2, 15 (which may be termed "auxiliary unit") takes in, through coupling 8, a portion of such delivered liquid, while complementary pumping unit 0, 13 takes in liquid coming from upstream 4 (i.e. directly from the source). When piston 14 of the first unit reaches its discharge stroke end and starts its suction stroke, liquid is delivered to downstream point 5 by the second pumping units 2, 15 and the complementary pumping unit 0, 13 which start their discharge stroke, while first pumping unit 1, 14 takes in liquid stemming in part from the source and in part from the output of complementary pumping unit 0, 13. It is thus seen that at no time there is any interruption of the suction effect in the upstream portion of feed line 3 located between coupling 6 and point 4. Consequently, there is no risk of cavitation or similar perturbation of the liquid flow which might impair the delivery of the liquid to point 5 at a rigorously constant flow rate.

Such constant flow rate is achieved with the installation shown in FIG. 1 by selecting the respective capacities of the pumping unit cylinders as set forth herein-above, i.e. the capacity $V_1$ of cylinder 1 of first pumping unit 1, 14 is equal to the sum of the respective capacities $V_2$ and $V_0$ of the cylinders 2, 0 of the second and complementary pumping units 2, 15 and 0, 13, respectively, thus:

$$V_1 = V_0 + V_2$$

or:

$$V_0 = V_1 - V_2$$

or:

$$V_2 = V_1 - V_0$$

It should be noted that, depending on the conditions of feeding the liquid to feed line 3, the cross-sectional dimensions of the latter and other technical characteristics, check valves 9 and 12 may possibly be omitted without impairing the operation of the instant installation.

As set forth herein-above, it has been found that a pumping system incorporating the features according to the invention as described and shown allows a perfectly constant flow rate to be obtained, without any risk of cavitation or other undesirable phenomena which would impede the delivery of the liquid in accordance with this requirement, which is imperative especially when such liquid is to be fed to a chromatograph or similar apparatus.

Figure 2:
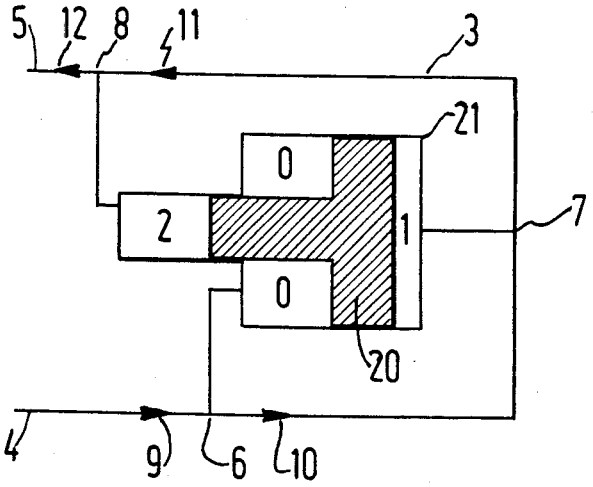
FIG. 2 shows a second embodiment of the invention.

FIG. 2 shows another embodiment of the invention, wherein the three pumping units of FIG. 1 are replaced by one single pumping assembly performing the same functions as said three units. This embodiment comprises a single cylinder 21 having a portion 21*a* with a bore of a comparatively large diameter and a portion 21*b* with a bore of a comparatively small diameter. A T-shaped piston 20 is mounted in cylinder 21 and comprises a comparatively large diameter portion 20 and a comparatively small diameter portion 20*b*. Piston portion 20 is placed in large diameter bore portion 21*a* of the cylinder, while small diameter piston portion 20*b* is placed in small diameter bore portion 21*b* of said cylinder. Piston and bore portions 20*a*, 20*b*, 21*a*, 21*b* are coaxial, and the piston is reciprocally movable in the direction of the common axis of said portions. As indicated schematically in FIG. 2, piston 20 is actuated by means of a cam 170 mounted on a rotatably driven shaft 19 and shaped in such a manner that each one of the alternating motions of the piston are effected in accordance with a linear characteristic, i.e. at a strictly constant speed.

Piston 20 delimits within cylinder 21 three chambers 0, 1, 2 which are tightly separated from each other. Chamber 1 is defined between the large diameter end face of piston 20 (i.e. the free end face of piston portion 20*a*) and the adjacent end wall of large diameter bore portion 21*a* of cylinder 21. Chamber 2 is delimited between the free small diameter end face of piston 20 (i.e. the free end face of small diameter piston portion 20*b*) and the end wall of small diameter bore portion 21*b* of cylinder 21. Chamber 0 is an annular chamber coaxially surrounding a related section of small diameter piston portion 20*b* and delimited by the annular opposite end face of large diameter piston portion 20*a* which encircles said piston portion 20*b* in the plane of connection of said portions 20*a* and 20*b*, and by the annular opposite end wall of large diameter bore portion 21*a* by which the latter is connected to small diameter bore portion 21*b*.

A feed line 3 similar to that shown in FIG. 1 extends between an upstream point 4 (corresponding to the liquid source S) and a downstream point 5 (corresponding to apparatus such as a chromatograph C) and is provided with T-couplings 6, 7 and 8 connecting said feed line to chambers 0, 1 and 2, respectively. Check valves 9, 10, 11 and 12 similar to those identically referenced in FIG. 1 are disposed and operate in the same manner as described herein-above with reference to FIG. 1, check valves 9 and 12 not being indispensable under certain conditions, as already set forth.

It will be eaasily understood that, when piston 20 is reciprocated in cylinder 21 by driving means 19, 170, chambers 1, 2 and 0 will act exactly in the same way as pumping units 1, 14 and 2, 15 and 0, 13, respectively shown in FIG. 1. Indeed, when piston 20 is displaced toward the right (with reference to FIG. 2), it performs a motion that corresponds to the discharge stroke for chamber 1 and to the suction stroke for chambers 2 and 0. The inverse displacement of piston 20 corresponds similarly to the suction stroke for chamber 1 and to the discharge stroke for either chamber 2 and 0. The respective capacities of chambers 1, 2 and 0 are selected so as to comply with the conditions indicated herein-above, $V_1$ of the above equations representing in the present case the capacity of chambers 1, $V_2$ the capacity of chamber 2 and $V_0$ the capacity of chamber 0. Thus the principle of operation and the result achieved are similar to those described herein-before with reference to FIG. 1 and in the introductory part of the present disclosure.

Amongst other possible variants, the driving mechanism shown and described may be replaced by any mechanism other than a cam shaft and follower assembly, provided that such mechanism is capable of imparting a "linear" motion to the pistons as indicated above.

In the embodiment according to FIG. 1, any one of the three cylinder and piston units can be replaced by two or more such units, provided that the ratio of the respective capacities according to the invention, as set forth, is maintained.

To state it more generally, the invention is not limited to the embodiments shown and described herein. Many modifications and variants can be envisaged by those skilled in the art to which it relates, without departing from the spirit and scope of the invention as defined in the appended claims.

I claim:

1. A pumping system comprising at least one first unit including cylinder means and reciprocating piston means therein and defining a first pumping capacity ($V_1$), at least one second pumping unit including cylinder means and reciprocating piston means therein and defining a second pumping capacity ($V_2$), at least one complementary pumping unit including cylinder means and reciprocating piston means therein and defining a complementary pumping capacity ($V_0$), driving means for actuating said piston means synchronously but in phase opposition between the piston means of said first unit, on the one hand, and said second and complementary units, on the other hand, in such a manner that each piston performs alternating suction and discharge strokes, a feed line having an upstream end connected to a liquid source and a downstream end connected to the apparatus to be fed with said liquid, said first pumping unit being connected to said feed line at a first connecting point located between said upstream and downstream ends thereof, said second pumping unit being connected to said feed line at a second connecting point located between said first connecting point and said feed line downstream end, said complementary pumping unit being connected to said feed line at a third connecting point located between said first connecting point and said feed line upstream end, a first check valve mounted in said feed line at a location between said first and complementary connecting points and adapted to allow liquid to flow through said feed line only in the direction toward said downstream point, a second check valve mounted in said feed line at a location between said first and second connecting points and adapted to allow liquid to flow through said feed line only in the direction toward said downstream point, optional third and fourth check valves mounted on said feed line at respective locations upstream from said complementary connecting point and downstream from said second connecting point and adapted to allow liquid to flow through said feed line only in the direction toward said downstream point, characterized in that said first, second and complementary pumping units define pumping capacities $V_1$, $V_2$ and $V_0$, respectively, which are different from one another; that said driving means comprise a rotatively driven shaft provided with a cam which is drivingly connected through follower means to said piston and which is provided with a profile having the shape of an arithmetical spiral on three-quarters of its angular displacement; and that the respective pumping capacities of said three units and said driving means and so selected and arranged that the ratio of said complementary pumping capacity ($V_0$) to the suction stroke time ($t_{R1}$) of said first unit equals the ratio of said first pumping capacity ($V_1$) to the sum of the suction and discharge stroke times ($t_{A1}$ and $t_{R1}$) of said first unit and equals the ratio of said second pumping capacity ($V_2$) to the suction stroke time ($t_{A1}$) of said first unit, as expressed by:

$$(V_0/t_{R1})=(V_1/t_{A1}+t_{R1})=(V_2/t_{A1})$$

whereby said pumping capacities are such that said first pumping capacity $V_1$ equals the sum of said second and complementary capacity ($V_0$) as expressed by: $V_1=V_2+V_0$.

2. The pumping unit of claim 1, wherein said pumping units are constituted by an assembly comprising a cylinder having one large diameter bore section and one small diameter bore section coaxial therewith, and one piston having a large diameter piston section and a small diameter piston section coaxial and integral therewith, said large sections of said cylinder and said piston, on the one hand, and said small diameter sections of said cylinder and said piston, on the other hand, having respectively corresponding diameters and said piston being reciprocatingly mounted in said cylinder with said large piston section placed in said large cylinder bore section and said small piston section placed in said small cylinder bore section, so as to define a first pumping unit chamber between the large piston section end face opposite to said small piston section, on the one hand, and the large bore section end wall adjacent thereto, on the other hand, a second pumping unit chamber between the small piston section end face and the end wall of said small diameter bore section, and an annular complementary pumping unit chamber surrounding the periphery of said small diameter piston section and delimited by an annular end wall portion of said large piston section which encircles said small piston section, on the one hand, and an annular end wall portion of said large bore section which connects the side wall thereof to said small bore section, on the other hand, said first, second and complementary pumping unit chambers being connected to said feed line at said first, second and third connecting point, respectively, and said piston being actuated for alternative motion in said cylinder by said driving means, wherein the respective capacities of said first, second and complementary pumping unit chambers constitute said first, second and complementary pumping capacities, respectively.

3. A liquid chromatography device which includes the pumping system of claim 1.

* * * * *